US006583692B2

(12) United States Patent
Holme et al.

(10) Patent No.: US 6,583,692 B2
(45) Date of Patent: Jun. 24, 2003

(54) MULTIPLE PASSBAND FILTER

(75) Inventors: Stephen C. Holme, San Ramon, CA (US); Hiroyuki Ikemoto, Cupertino, CA (US)

(73) Assignee: Space Systems/Loral, Inc., Palo Alto, CA (US)

( * ) Notice: Subject to any disclaimer, the term of this patent is extended or adjusted under 35 U.S.C. 154(b) by 0 days.

(21) Appl. No.: 09/850,695

(22) Filed: May 8, 2001

(65) Prior Publication Data

US 2002/0167379 A1 Nov. 14, 2002

(51) Int. Cl.[7] ..... H01P 1/208; H01P 3/12
(52) U.S. Cl. ..... 333/212; 333/230; 333/209
(58) Field of Search ..... 333/212, 208, 333/209, 230, 202, 204, 239, 227, 235

(56) References Cited

U.S. PATENT DOCUMENTS 4,614,920 A * 9/1986 Tong ..... 333/135
4,721,933 A * 1/1988 Schwartz et al. ..... 333/212
5,012,211 A * 4/1991 Young et al. ..... 333/212
5,327,245 A * 7/1994 Unetich et al. ..... 348/723
6,008,706 A * 12/1999 Holme et al. ..... 333/132
6,157,274 A * 12/2000 Tada et al. ..... 333/204

OTHER PUBLICATIONS

Zverev, Anatol I., Handbook of Filter Synthesis, 1967, John Wiley & Sons, p. 44.*

* cited by examiner

*Primary Examiner*—Robert Pascal
*Assistant Examiner*—Dean Takaoka
(74) *Attorney, Agent, or Firm*—Kenneth W. Float

(57) ABSTRACT

A filter that produces a multiple passband response as a single device. The multiple passband filter has a plurality of poles concentrated in a desired passband of the filter. A plurality of zeroes are located outside of the desired passband to form passband edges. One or more zeroes are located in a central portion of the passband to form multiple passbands within the passband edges.

2 Claims, 5 Drawing Sheets

MULTIPLE PASSBAND FILTER

BACKGROUND

The present invention relates generally to electrical filters, and more particularly, to a multiple passband filter that passes multiple frequency bands using the same propagating mode while rejecting unwanted bands.

The assignee of the present invention manufactures and deploys communication satellites that provide global communication services. Waveguide filters are employed in communication systems carried by such communication satellites.

Heretofore, certain combinations of filters have been employed to perform the same function as the present filter. One prior art design includes a dual manifold multiplexer bandpass filter combined with band reject filters. Another prior art design includes a dual passband filter using multiple waveguide modes. Thus, prior art filters have always had a single passband or a multiple passband with multiple waveguide modes.

However, no prior art filter has provided a multiple passband filter that passes multiple frequency bands using the same propagating mode while rejecting unwanted bands. It is therefore an objective of the present invention to provide for a multiple passband filter that improves upon prior art filter designs.

SUMMARY OF THE INVENTION

To accomplish the above and other objectives, the present invention is an improved filter that produces a multiple passband response in a single device. The multiple passband filter comprises a plurality of poles concentrated in a desired passband of the filter. A plurality of zeroes are located outside of the desired passband to form passband edges. One or more zeroes are located in a central portion of the passband to form multiple passbands within the passband edges.

An exemplary embodiment of the multiple passband filter includes a plurality of cavities, one of which comprises an input port and another of which comprises an output port. Each of the cavities comprises first tuning apparatus disposed along a first axis for tuning the cavity to resonance in a first resonant mode, second tuning apparatus disposed along a second axis that is substantially orthogonal to the first axis for tuning the cavity to resonance in a second resonant mode, and mode coupling apparatus for adjusting the amount of energy coupled between the first and second resonant modes, wherein the mode coupling apparatus of adjacent cavities is disposed orthogonal with respect to each other.

Each of the orthogonal resonant modes is independently tunable to realize a separate pole of a filter function. A plurality of poles are concentrated in a desired passband of the filter, a plurality of zeroes are located outside of the desired passband to form passband edges, and one or more zeroes are located in a central portion of the passband to form multiple passbands within the passband edges.

The present invention provides for an improvement over prior art filters having a single passband or prior art filters having a multiple passband with multiple waveguide modes. The present invention provides the simplest filter design that produces a waveguide filter having multiple (two or more) passband response. Other prior art filters use extra parts such as manifolds or circulators.

BRIEF DESCRIPTION OF THE DRAWINGS

The various features and advantages of the present invention may be more readily understood with reference to the following detailed description taken in conjunction with the accompanying drawing figures, wherein like reference numerals designate like structural elements, and in which.

DETAILED DESCRIPTION

Figure 1A:
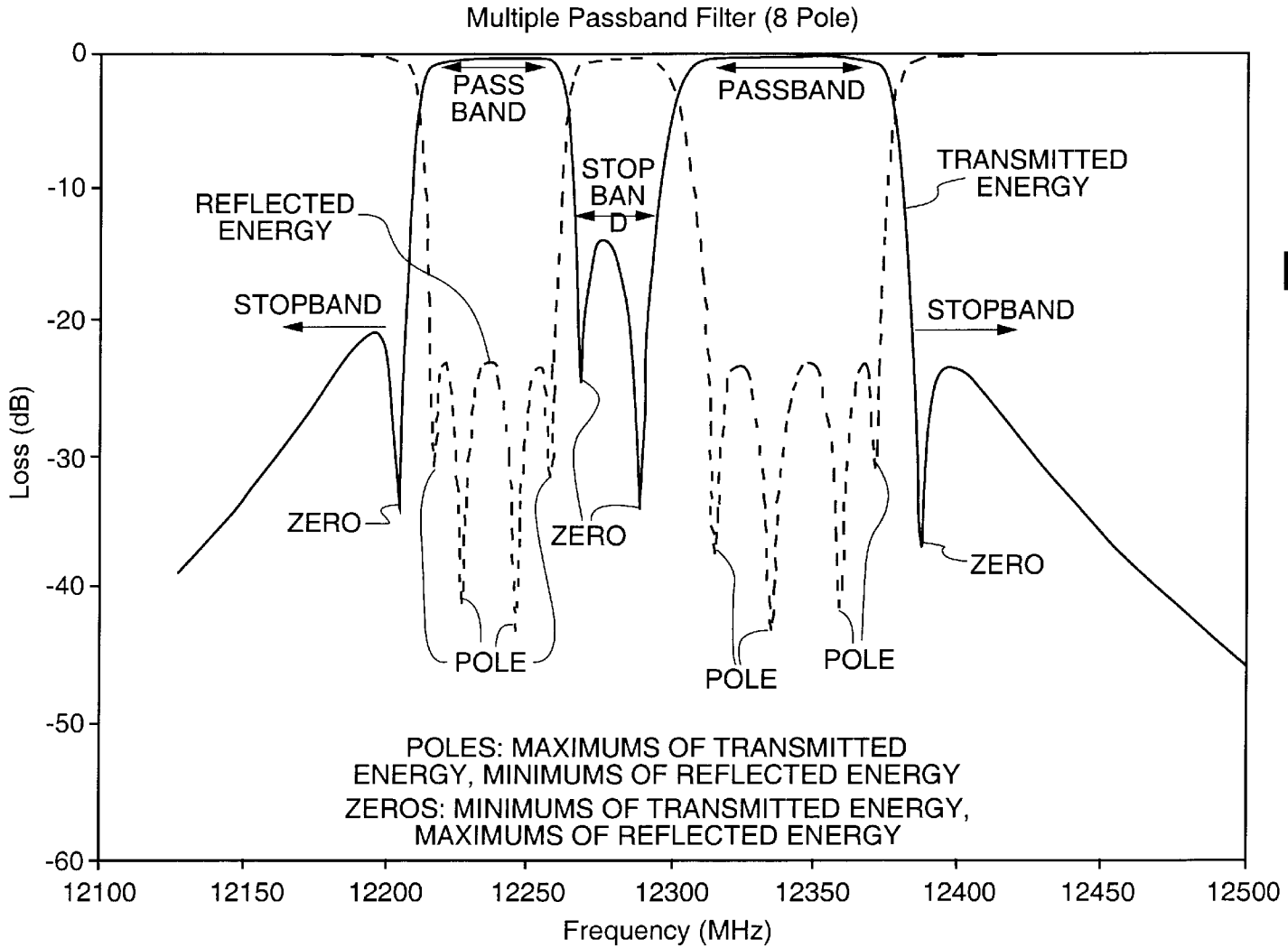
FIG. 1*a* is a plot that illustrates the filter response of an exemplary S pole multiple passband filter in accordance with the principles of the present invention and FIG. 1*b* is a plot that illustrates the filter response of a conventional 8 pole passband filter.
Figure 1B:
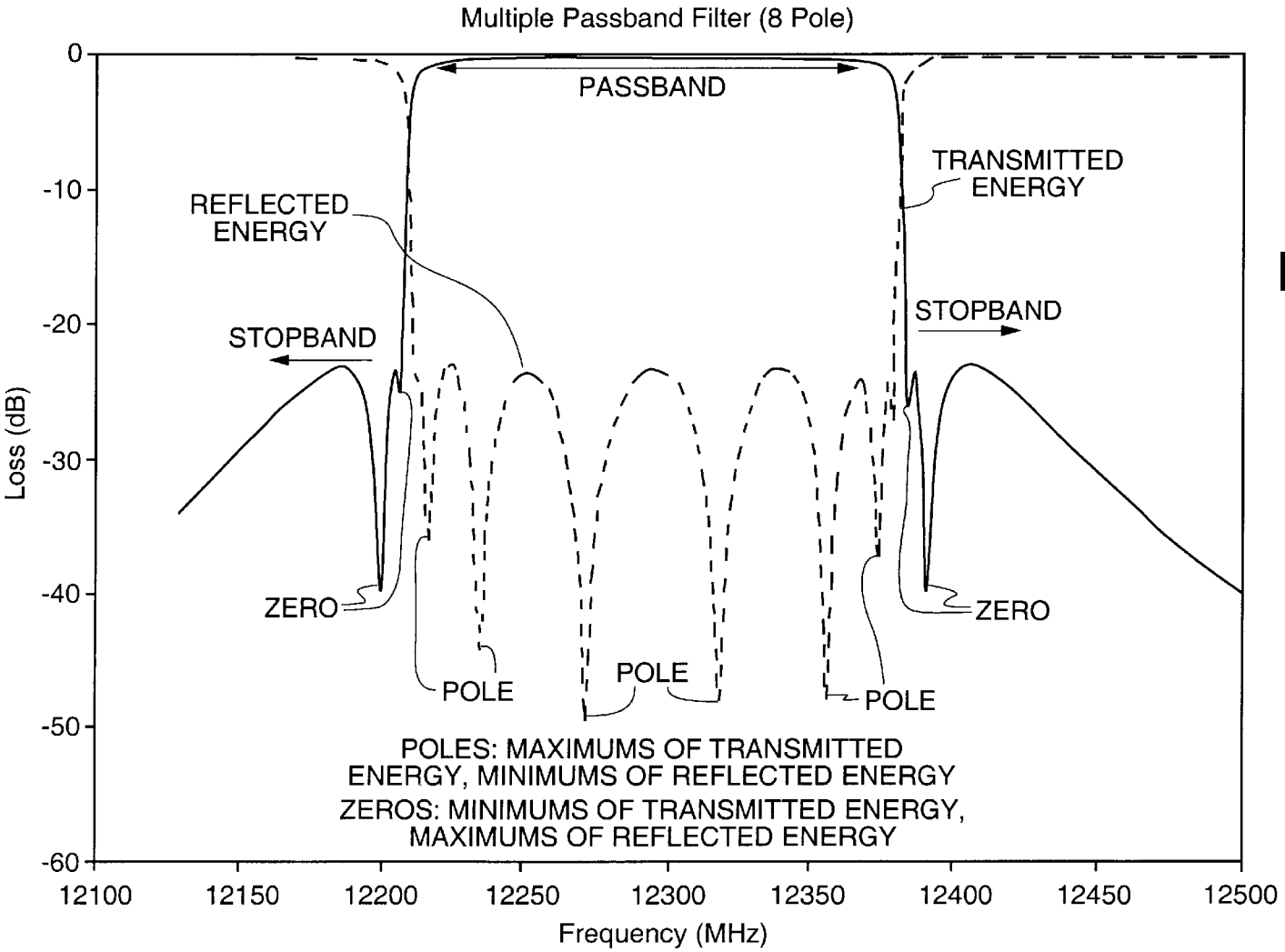

Referring to the drawing figures, FIG. 1*a* is a plot that illustrates the filter response of an exemplary 8 pole multiple passband filter in accordance with the principles of the present invention and FIG. 1*b* is a plot that illustrates the filter response of a conventional 8 pole passband filter.

A typical conventional filter design is comprised of poles concentrated in a desired passband, and zeroes located outside of the desired passband. As is shown in the FIG. 1*b* (dotted line), this produces a central low loss band, with a sharp cutoff at the upper and lower sides or edges of the passband.

The solid line in FIG. 1*a* illustrates the response of the present multiple (dual) band filter, where two zeroes have been relocated to a central part of the passband. In this way, two passbands, with a central rejection section, are realized with a single filter structure.

In general one or more zeros may be placed within the passband. Thus any number of passbands can be realized in this way by placing additional zeros in the central part of the passband.

Figure 2:
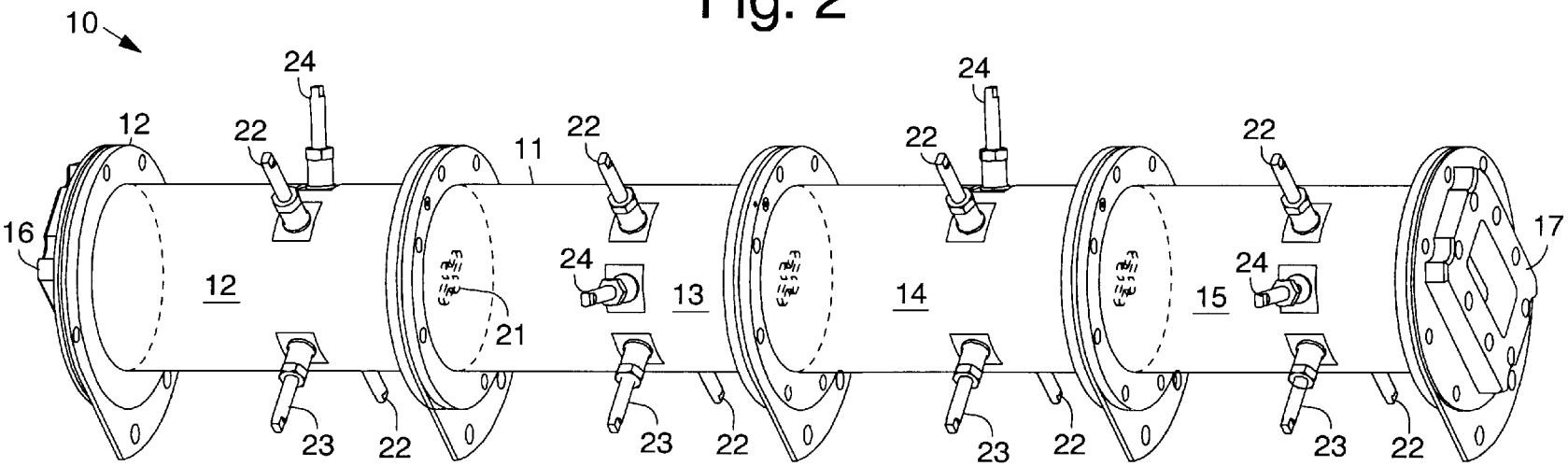
FIG. 2 is a perspective view of an exemplary multiple passband filter in accordance with the principles of the present invention.
Figure 3:
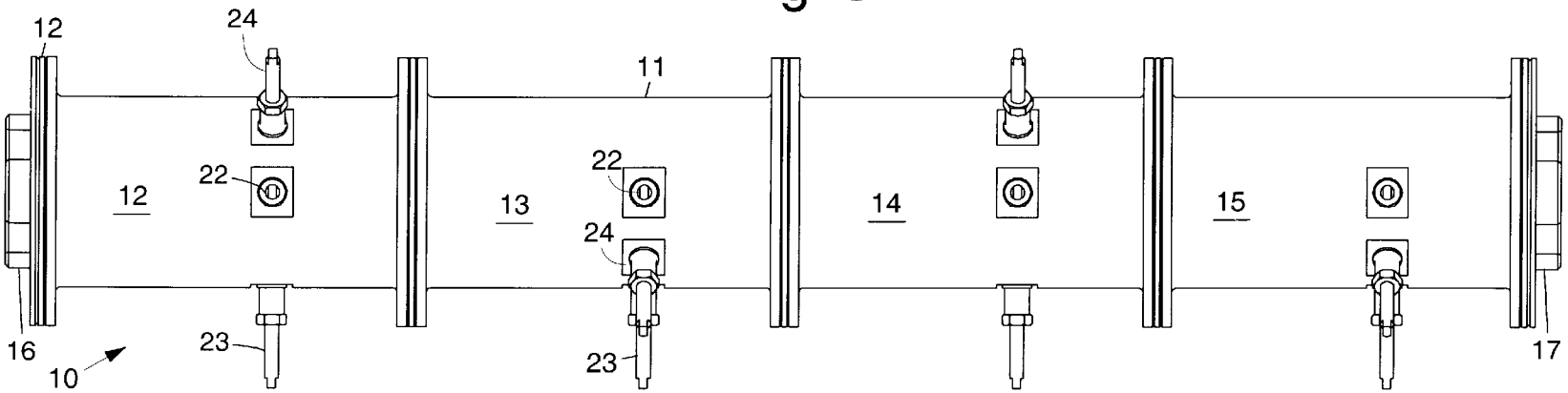
FIGS. 3 and 4 are top and side views of the exemplary multiple passband filter shown in FIG. 2.
Figure 4:
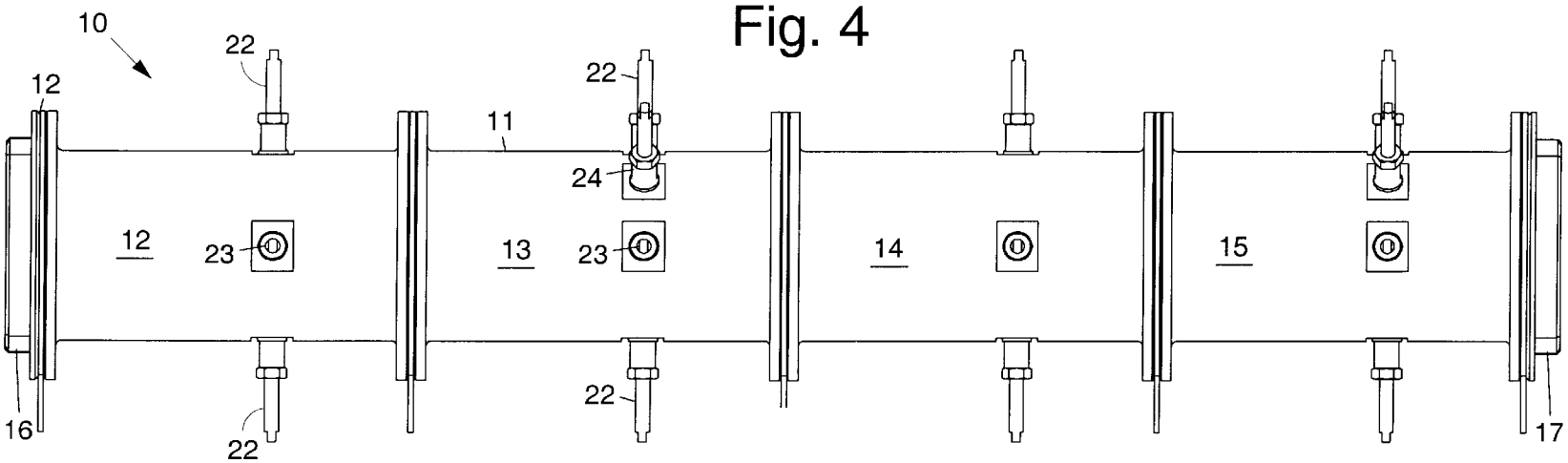
Figure 6:
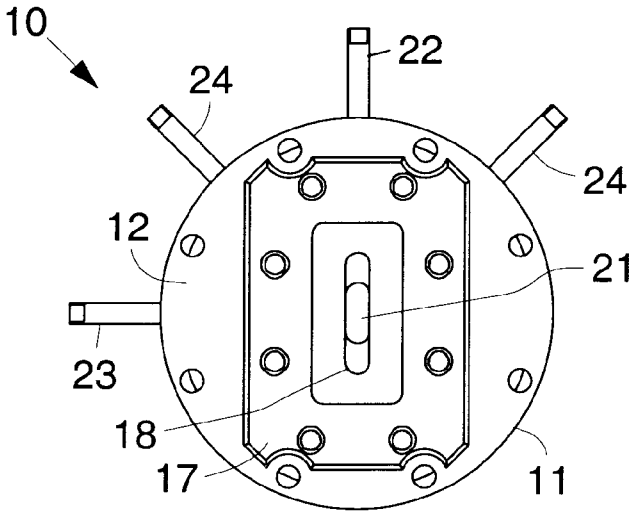
FIGS. 5 and 6 are end views of the exemplary multiple passband filter shown in FIG. 2.
Figure 5:
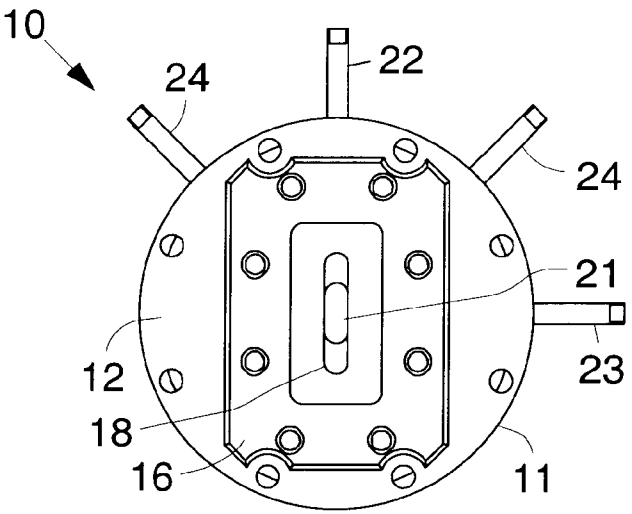

FIG. 2 is a perspective view of a reduced-to-practice embodiment of the multiple passband filter 10 in accordance with the principles of the present invention. FIGS. 3 and 4 are top and side views of the reduced-to-practice multiple passband filter 10. FIGS. 5 and 6 are end views of the reduced-to-practice multiple passband filter 10.

The multiple passband filter 10 comprises a cylindrical body 11 having an input cavity 12 two intermediate cavities 13, 14 and an output cavity 15. The input cavity 12 has an input port 16 and the output cavity 15 has an output port 17. In the exemplary embodiment, the input and output ports 16, 17 each comprise an input coupling device 18 in the form of a slot 18 (FIGS. 4 and 5).

A coupling iris 21 having a cruciform shape is disposed between each of the cavities 12–15. Each of the cavities 12–15 has a plurality of tuning devices 22, 23, 24 that are disposed along predetermined axes of the filter 10. First and second tuning devices 22 or screws 22 project into each cavity 12–15 along a first axis from opposite sides of the cavity 12–15. A third tuning device 23 or screw 23 projects into each cavity 12–15 along a second axis that is at an angle that is substantially 90° angle with respect to the first axis.

The first, second and third tuning screws 22, 23 serve to tune each cavity 12–15 to resonance in each of two orthogonal $TE_{114}$ resonant modes. The amount of projection of each tuning screw 22, 23 is independently adjustable, and each of the two orthogonal modes can be separately tuned to a precisely selected resonant frequency, so that the respective cavities 12–15 can provide a realization of two poles of a complex filter function. Each of the orthogonal resonant modes is tunable independently of the other, such that each can be used to realize a separate pole of a filter function.

A fourth tuning device 24 or screw 24 which comprises a mode coupling device 24 or screw 24 is disposed in each of the cavities 12–15. The mode coupling device 24 or screw 24 is disposed along a third axis of the input and second intermediate cavities 12, 14. The third axis is disposed substantially midway between the first and second axes at an angle of about 45° thereto.

The fourth tuning device 24 or mode coupling device 24 or screw 24 is disposed along a fourth axis of the first intermediate and output cavities 13, 15. The fourth axis is at an angle that is orthogonal to the third axis. The third and fourth mode coupling devices 24 provide a variable amount of coupling between the two orthogonal resonant modes in each cavity 13, 15.

The third and fourth mode coupling devices 24 serve to perturb the electromagnetic field of resonant energy within the cavity 12–15 such that energy is controllably coupled between the two orthogonal resonant modes. Moreover, the degree of such coupling is variable by varying the amount by which the third and fourth mode coupling devices 24 project into the respective cavity 12–15.

Thus, an improved multiple passband filter has been disclosed. It is to be understood that the above-described embodiment is merely illustrative of some of the many specific embodiments that represent applications of the principles of the present invention. Clearly, numerous and other arrangements can be readily devised by those skilled in the art without departing from the scope of the invention.

What is claimed is:

1. A multiple passband filter defined by:

a plurality of poles concentrated in a desired frequency range comprising a passband of the filter;

a plurality of zeroes located outside of the desired frequency range comprising the passband to form passband edges; and one or more zeroes located in a central portion of the frequency range comprising the passband to form multiple passbands within the passband edges.

2. A multiple passband filter comprising:

a plurality of cavities, one of which comprises an input port and another of which comprises an output port, each of the cavities further comprising:

first tuning apparatus disposed along a first axis for tuning the cavity to resonance in a first resonant mode;

second tuning apparatus disposed along a second axis that is substantially orthogonal to the first axis for tuning the cavity to resonance in a second resonant mode; and mode coupling apparatus for adjusting the amount of energy coupled between the first and second resonant modes, wherein the mode coupling apparatus of adjacent cavities is disposed orthogonal with respect to each other;

wherein each of the orthogonal resonant modes is independently tunable to realize a separate pole of a filter function, and wherein a plurality of poles are concentrated in a desired frequency range comprising the passband of the filter, a plurality of zeroes are located outside of the desired frequency range comprising the passband to form passband edges, and one or more zeroes are located in a central portion of the frequency range comprising the passband to form multiple passbands within the passband edges.

* * * * *